US009841187B2

(12) United States Patent
Takeuchi

(10) Patent No.: US 9,841,187 B2
(45) Date of Patent: Dec. 12, 2017

(54) COMBUSTION PLATE

(71) Applicant: Rinnai Corporation, Nagoya-shi, Aichi (JP)

(72) Inventor: Masaru Takeuchi, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 268 days.

(21) Appl. No.: 14/918,779

(22) Filed: Oct. 21, 2015

(65) Prior Publication Data

US 2016/0116160 A1 Apr. 28, 2016

(30) Foreign Application Priority Data

Oct. 24, 2014 (JP) ..... 2014-216857

(51) Int. Cl.

| | |
|---|---|
| ***F23D 14/02*** | (2006.01) |
| ***F23D 14/14*** | (2006.01) |
| ***F23D 14/74*** | (2006.01) |
| ***F23D 14/82*** | (2006.01) |

(52) U.S. Cl.

CPC ..... *F23D 14/14* (2013.01); *F23D 14/02* (2013.01); *F23D 14/74* (2013.01); *F23D 14/82* (2013.01); *F23D 2203/005* (2013.01); *F23D 2203/1023* (2013.01); *F23D 2212/10* (2013.01); *F23D 2900/00003* (2013.01)

(58) Field of Classification Search

CPC ..... F23D 14/02; F23D 14/14; F23D 14/74; F23D 14/82

USPC ..... 431/328, 278, 326, 12

See application file for complete search history.

(56) References Cited

U.S. PATENT DOCUMENTS 3,251,396 A * 5/1966 Nitsche ..... F23C 99/00 431/328
3,825,403 A * 7/1974 Gottschall ..... F23D 14/14 431/328
4,083,673 A * 4/1978 Robinson ..... B60H 1/00264 237/12.3 C
4,504,218 A * 3/1985 Mihara ..... C04B 35/803 431/326

(Continued)

FOREIGN PATENT DOCUMENTS

JP 06147435 A * 5/1994
JP 7-12713 A 3/1995

(Continued)

*Primary Examiner* — Gregory Huson
*Assistant Examiner* — Nikhil Mashruwala
(74) *Attorney, Agent, or Firm* — Westerman, Hattori, Daniels & Adrian, LLP

(57) ABSTRACT

A combustion plate is for use in a totally aerated combustion burner in which a plate main body made of ceramic has formed therein a multiplicity of flame holes for ejecting a premixed gas. The plate main body is provided, in a lattice shape, with non-flame-hole sections free of flame holes. Each of those sections of the plate main body which are enclosed by the non-flame-hole sections constitutes a collective flame-hole section having formed therein in a crowded manner a plurality of flame holes. Flame holes formed in those peripheral portions of the collective flame-hole sections which are adjacent to the non-flame-hole sections are smaller in diameter than the diameter of the flame holes formed in those portions of the collective flame-hole sections which are inner than the peripheral portions.

2 Claims, 4 Drawing Sheets

(56) References Cited

U.S. PATENT DOCUMENTS

| | | | | | |
|---|---|---|---|---|---|
| 4,569,657 | A * | 2/1986 | Laspeyres | F23D 14/14 | 431/326 |
| 6,896,512 | B2 * | 5/2005 | Rattner | F23D 14/16 | 126/91 R |
| D676,707 | S * | 2/2013 | Okamoto | D7/407 | |
| 8,827,693 | B2 * | 9/2014 | Akagi | F23D 14/62 | 431/326 |
| 9,182,118 | B2 * | 11/2015 | Akagi | F23D 14/58 | |
| 9,291,346 | B2 * | 3/2016 | Lenoir | F23D 14/14 | |
| 9,557,055 | B2 * | 1/2017 | Hagi | F23D 14/34 | |
| 2009/0291402 | A1 * | 11/2009 | Cho | F23D 14/58 | 431/278 |
| 2013/0337390 | A1 | 12/2013 | Akagi et al. | | |
| 2016/0161113 | A1 * | 6/2016 | Takeuchi | F23D 14/14 | 431/328 |

FOREIGN PATENT DOCUMENTS

| | | | | | |
|---|---|---|---|---|---|
| JP | 10332113 | A | * 12/1998 | | |
| JP | 11351522 | A | * 12/1999 | F23D 14/58 | |
| JP | 2009103407 | A | * 5/2009 | F23D 14/02 | |
| JP | 2012-180988 | A | 9/2012 | | |

* cited by examiner

COMBUSTION PLATE

BACKGROUND OF THE INVENTION

1. Field of the Invention

The present invention relates to a combustion plate for use in a totally aerated combustion burner (or a fully primary aerated burner) in which a plate main body made of ceramic has formed therein a multiplicity of flame holes (burner holes) for ejecting a premixed gas. The combustion plate is disposed in a heat source equipment mainly for supplying hot water or for heating a residential space.

2. Description of the Related Art

As this kind of combustion plate, there is known one in which non-flame-hole sections (i.e., sections free of flame holes, or sections having no flame holes) are formed on a plate main body in a lattice shape, and in which each of the sections of the plate main body enclosed by the non-flame-hole sections is arranged to be a collective flame-hole section having formed therein in a crowded manner a plurality of flame holes (see, for example, Patent Document 1, i.e., JP-UM-A-1995-12713). According to this arrangement, the premixed gas that is ejected through flame holes around the periphery of the collective flame-hole sections adjacent to the non-flame-hole sections partly recirculates in a manner to swirl above the non-flame-hole sections. Then, the premixed gas that recirculates back from the flame holes around the periphery of the collective flame-hole sections that are positioned on both sides of the non-flame-hole sections interfere with each other. As a result, there will be formed, above the non-flame-hole sections, stable flames that are hard to be lifted off, thereby obtaining flame holding (stabilizing) effect.

However, once flame lifting takes place in a part of the flames of that peripheral portion of the collective flame-hole sections which is adjacent to a non-flame-hole section, the portion in question will serve as an origin, thereby giving rise to possible accompanying of the flame lifting in other flame holes in the peripheral portions [note: in this specification the expression of "that . . . which" or "those . . . which" often appear. In the above example, the phrase "(which) is adjacent to . . . " refers back to "(that) peripheral portion" and not to "collective flame-hole sections"; the meaning is thus "peripheral portion . . . is adjacent to", not "collective flame-hole sections . . . is adjacent to . . . "]. Particularly, in case the excess air ratio (primary air amount/stoichiometric air amount) of the premixed gas is made higher, flame lifting is likely to take place in the flame holes of the peripheral portion. Due to this phenomenon, flame lifting may take place in the entire collective flame-hole sections.

As a solution to the above-mentioned problem, there is known in the Patent Document 1 a combustion plate in which the flame holes formed in the peripheral portions adjacent to the non-flame-hole sections are arranged to be speed-reduction flame holes having a smaller diameter on a rear-surface side than the diameter on a front-surface side. In the speed-reduction flame holes the flow velocity of the premixed gas that enters the small-diameter portion on the rear-surface side is reduced in velocity in the enlarged-diameter portion on the front-surface side. In this manner, the flame lifting is less likely to take place and, consequently, the flame lifting around the peripheral portions of the collective flame-hole sections can be effectively prevented.

However, the arrangement referred to above has a disadvantage in that flashback is likely to occur at the time of low-load combustion. In other words, at the non-flame-hole sections, there cannot be obtained an effect of cooling the plate main body by the premixed gas that flows through the flame holes. Therefore, when the flames become short in the low-load combustion so that combustion takes place near the surface of the plate main body, the temperature of the non-flame-hole sections rises. Consequently, the temperature of the peripheral portions of the collective flame sections that is adjacent to the non-flame-hole sections also rises. As a combined result in that the flow velocity of the premixed gas is reduced because the flame holes around the peripheral portions are speed-reduction flame holes, flashback is likely to occur.

Further, as a combustion plate in which the flame holes in the peripheral portions of the collective flame-hole sections are not arranged to be speed-reduction flame holes, but is arranged to prevent the flame lifting from taking place in the peripheral portions, there is known a combustion plate as disclosed in Patent Document 2, i.e., JP-A-2012-180988. In other words, in each of those side portions of the non-flame-hole sections which is adjacent to respective collective flame-hole sections of the non-flame-hole sections, there are formed flame holes at a predetermined spacing in the longitudinal direction of the non-flame-hole sections. This predetermined spacing is set to be greater than the spacing, in the longitudinal direction, between adjoining flame holes formed in the collective flame-hole sections. According to this arrangement, resistivity against flashback at the time of low-load combustion shows improvement over the resistivity of the one as described in Patent Document 1. However, there is no change in the fact that the temperature of the non-flame-hole sections rises at the time of low-load combustion. Hence the resistivity (performance) against flashback cannot sufficiently be improved.

SUMMARY

Problems that the Invention is to Solve

In view of the above points, it is an advantage of the invention to provide a combustion plate that is capable of improving the resistivity against flashback.

Means for Solving the Problems

In order to solve the above-mentioned problems, the invention is a combustion plate for use in a totally aerated combustion burner in which a plate main body made of ceramic has formed therein a multiplicity of flame holes for ejecting a premixed gas. The plate main body is provided, in a lattice shape, with non-flame-hole sections free of flame holes. Each of those sections of the plate main body which are enclosed by the non-flame-hole sections constitutes a collective flame-hole section having formed therein in a crowded manner a plurality of flame holes. Flame holes formed in those peripheral portions of the collective flame-hole sections which are adjacent to the non-flame-hole sections are smaller in diameter than the diameter of the flame holes formed in those portions of the collective flame-hole sections which are inner than the peripheral portions.

According to this invention, by making smaller in diameter the flame holes formed in those peripheral portions of the collective flame-hole sections (the flame holes in question are called "peripheral flame holes"), the amount of premixed gas to be ejected from the peripheral flame holes is reduced, and the amount of heating the non-flame-hole portions due to the combustion of the premixed gas can be reduced. As a result, as compared with a case in which the diameter of the peripheral flame holes is not made smaller, the temperature of the non-flame-hole sections at the time of low-load combustion can be lowered, thereby improving the resistivity against flashback.

Further, in this invention, in a manner similar to that in the known example as described in the above-mentioned Patent Document 2, preferably, the flame holes are formed in each of those side portions of the non-flame-hole sections which are adjacent to the respective collective flame-hole sections, the flame holes being formed at a predetermined spacing from one another in a longitudinal direction of the non-flame-hole sections. And the predetermined spacing is set larger than the spacing from one another of the flame holes formed in the collective flame-hole sections as seen in a direction parallel to the longitudinal direction of the non-flame-hole sections. Then, flame lifting at the peripheral portions of the collective flame-hole sections can be prevented. In this case, since the flame holes formed in each of the side portions of the non-flame-hole sections (the flame holes are called "outside flame holes") are small in number, the diameter of the outside flame holes need not be made smaller. Instead, the peripheral flame holes may be made smaller in diameter. The temperature of the non-flame-hole portions can thus be lowered at the time of low-load combustion. In this invention, however, the outside flame holes shall preferably be made also smaller in diameter than the diameter of the flame holes formed in those portions of the collective flame-hole sections which are inner than the peripheral portions. According to this arrangement, by reducing the amount of the premixed gas to be ejected from the outside flame holes, the amount of heating the non-flame-hole sections by combustion of the premixed gas can be reduced. By still further lowering the temperature of the non-flame-hole sections at the time of low-load combustion, the resistivity against flashback can further be improved.

PREFERRED EMBODIMENTS FOR CARRYING OUT THE INVENTION

Figure 1:
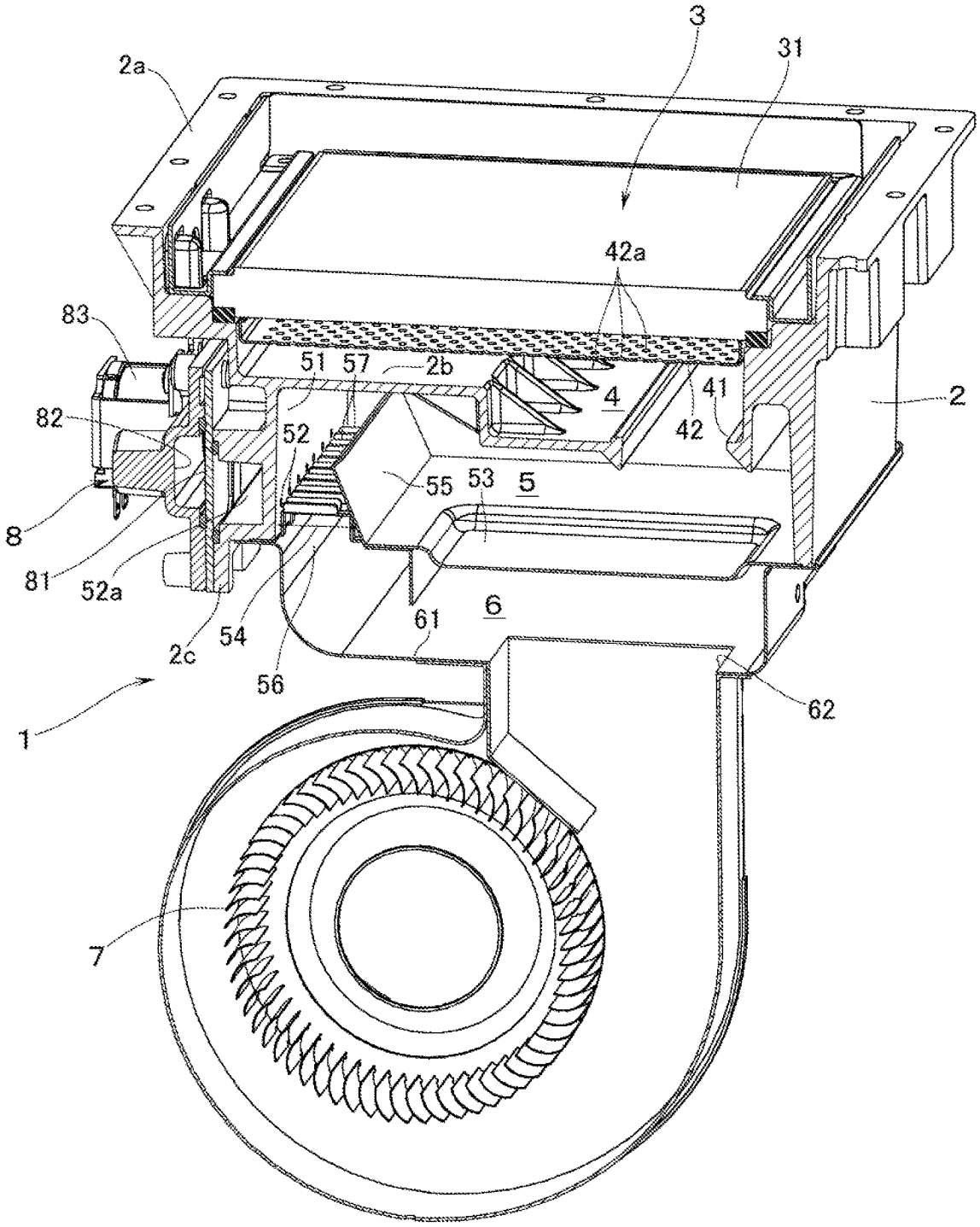
FIG. 1 is a partially cutaway perspective view of a totally aerated combustion burner.

With reference to FIG. 1, reference numeral 1 denotes a totally aerated combustion burner (or a fully primary aerated burner). The burner 1 has a burner main body 2 which is formed into a box shape so as to open upward, and a combustion plate 3 which is mounted on an upper part of the burner main body 2. Description will be made hereinafter on condition that the width direction of the burner 1 is defined as a lateral side direction and that the depth direction of the burner 1 is defined as a longitudinal (back-and-forth) direction.

Around an outer periphery of the upper surface of the burner main body 2, there is disposed a flange portion 2*a* to which is connected a lower end of a combustion housing (not illustrated) in which are housed a heat exchanger for supplying hot water or for heating a residential space. Further, the burner main body 2 is provided therein with: a distribution chamber 4 which faces the lower surface of the combustion plate 3; and, on the lower side of the distribution chamber 4, a mixing chamber 5 which is partitioned from the distribution chamber 4 by a floor wall 2*b* which is integral with the burner main body 2. Still furthermore, an air supply chamber 6 is disposed on the lower side of the mixing chamber 5. A combustion fan 7 is connected to an air supply port 62 which is opened through a bottom surface 61 of the air supply chamber 6 so that the primary air is supplied from the combustion fan 7 to the air supply chamber 6.

At a rear part of the floor wall 2*b* that is the bottom surface of the distribution chamber 4, there is formed a laterally elongated opening portion 41 which is communicated with the mixing chamber 5. The distribution chamber 4 is partitioned into upper and lower, i.e., a total of two, spaces by a partition plate 42. It is thus so arranged that a premixed gas that flows from the mixing chamber 5 into the lower space of the distribution chamber 4 through the opening portion 41 is introduced into the combustion plate 3 through a multiplicity of distribution holes 42*a*, formed in the partition plate 42, and through the upper space of the distribution chamber 4.

The front surface 51 of the mixing chamber 5 is closed by a vertical wall 2*c* which is integral with the burner main body 2. The front surface 51 is provided with a plurality of nozzle holes 52 which are made up of holes penetrating the vertical wall 2*c* in a manner parallel with, and at a lateral spacing from, one another. Moreover, on an outer surface of the vertical wall 2*c*, there is mounted a gas manifold 8 through a partition plate 81 which defines a nozzle passage 52*a* communicating with the plurality of nozzle holes 52 between the partition plate 81 and the vertical wall 2*c*. The partition plate 81 is provided with an opening (not illustrated) which communicates a gas passage 82 inside the gas manifold 8 and the nozzle passage 52*a* together. The gas manifold 8 is provided with a solenoid valve 83 which opens and closes the above-mentioned opening. It is thus so arranged that, when the solenoid valve 83 is opened, the fuel gas is supplied to the nozzle passage 52*a* so that the fuel gas is ejected from each of the nozzle holes 52.

On the bottom surface 53 of the mixing chamber 5, there is disposed a wall plate 55 upright in a manner to lie opposite to the front surface 51 of the mixing chamber 5 while leaving (or maintaining) a ventilation clearance 54 between the front surface 51 and the wall plate 55 so that the fuel gas to be ejected from each of the nozzle holes 52 collides with the wall plate 55. The wall plate 55 is extended upward and is inclined in a forward direction. In that portion of the bottom surface 53 of the mixing chamber 5 which faces the ventilation clearance 54, there is formed a laterally elongated air inlet 56 which introduces the primary air from the air supply chamber 6 into the mixing chamber 5. It is thus so arranged that the fuel gas ejected from each of the nozzle holes 52 is diffused by colliding with the wall plate 55, that the diffused fuel gas gets mixed with the primary air that flows into the ventilation clearance 54 so as to accelerate the mixing of the fuel gas and the primary air, and consequently that the homogeneous premixed gas can be generated.

Furthermore, the ventilation clearance 54 is provided with longitudinally elongated baffle plates 57 in a trough shape so as to be positioned under each of the nozzle holes 52. According to this arrangement, even in weak combustion when the amount of ejection of the fuel gas is reduced to a small amount, the fuel gas can be collided with the wall plate 55 surely without being influenced by the primary air.

Figure 2:
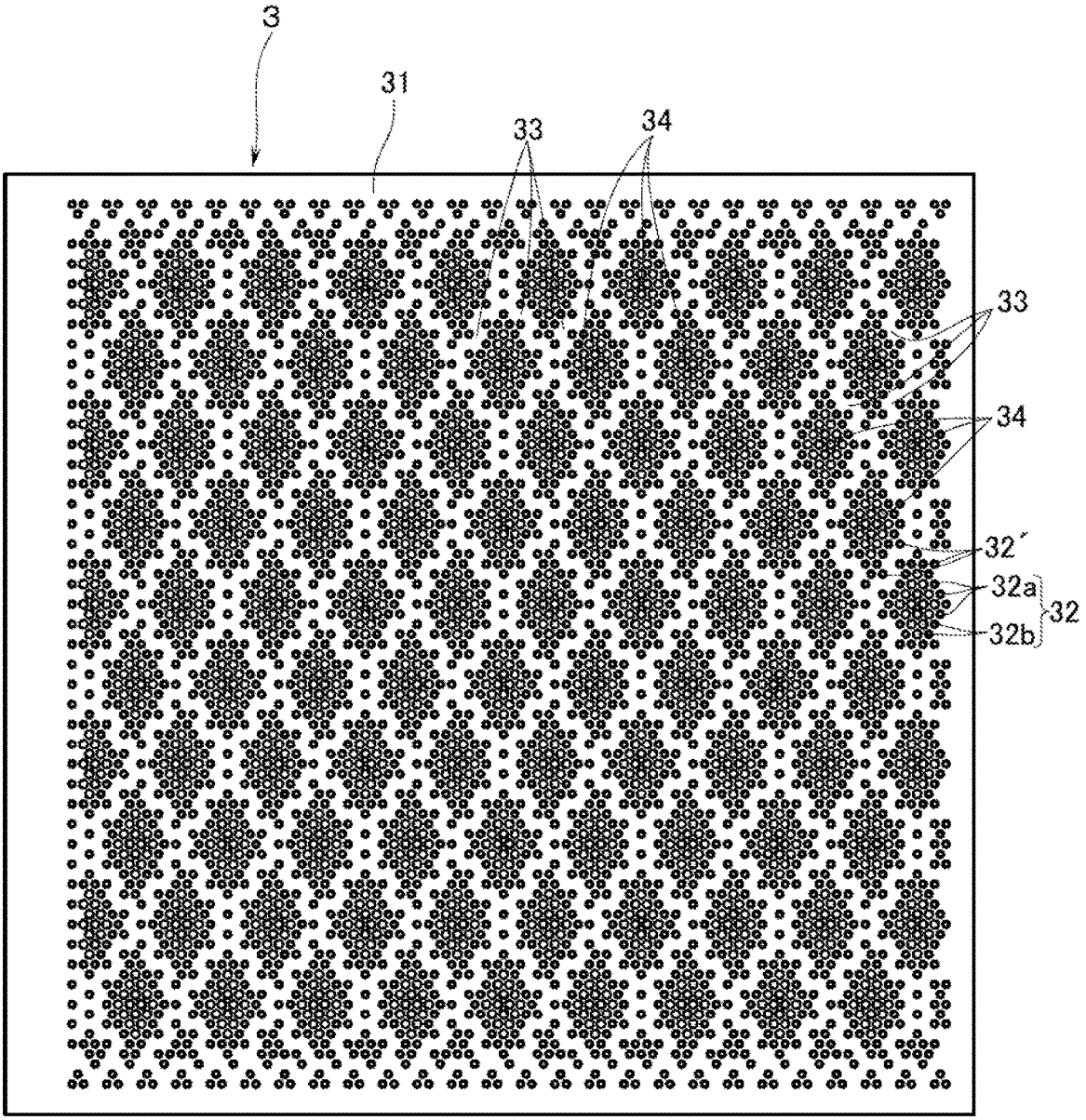
FIG. 2 is a plan view of a combustion plate according to an embodiment of this invention.

The combustion plate 3 is made up, as shown in FIG. 2, of a plate main body 31 made of ceramic and has formed therein a multiplicity of flame holes 32. The premixed gas is ejected from these flame holes 3*b* to perform totally aerated combustion. Detailed description will now be made of the combustion plate 3. It is to be noted here that the flame holes 32 are omitted in FIG. 1 to simplify the figure.

Figure 3:
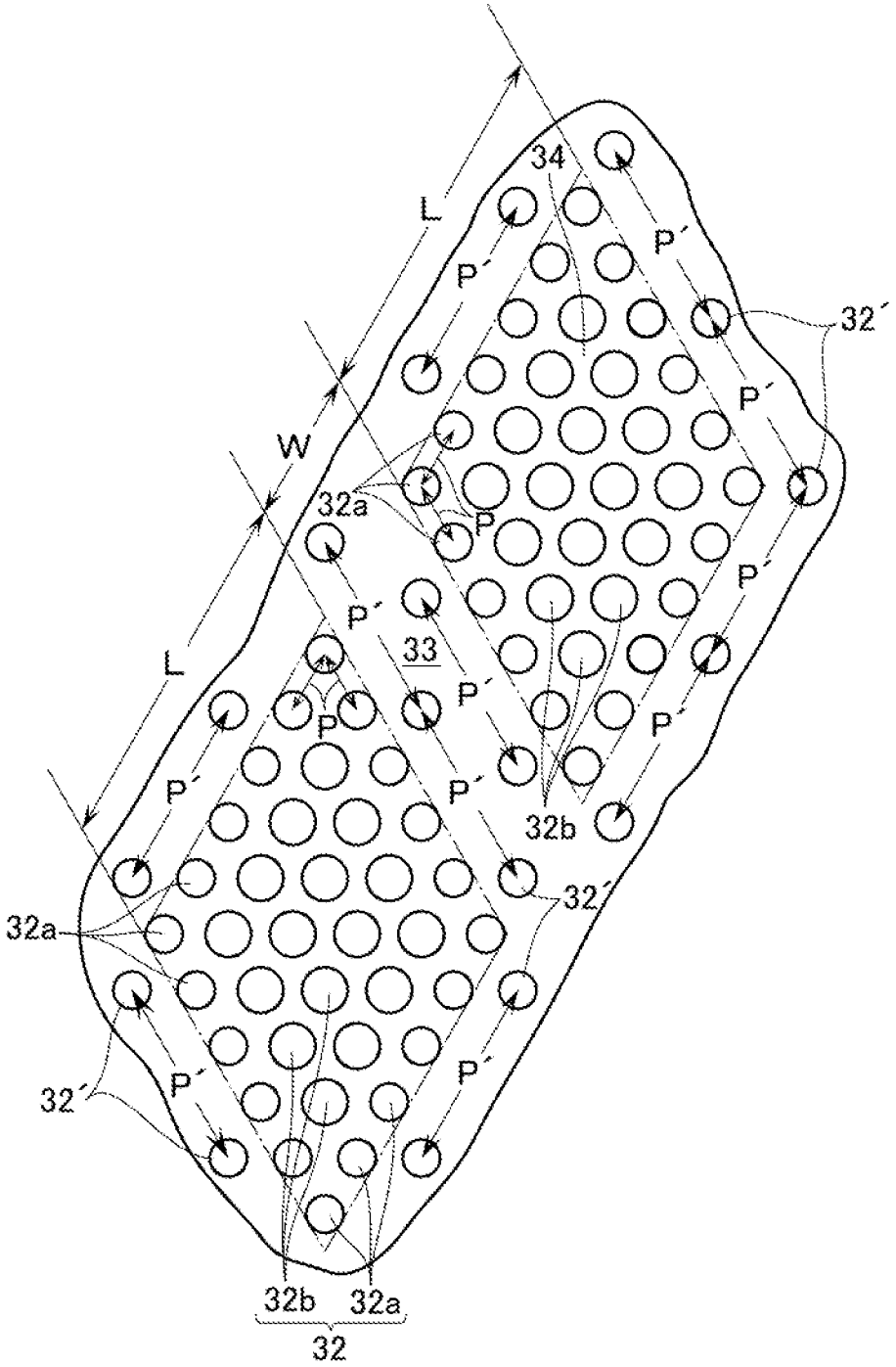
FIG. 3 is a partly enlarged plan view of the combustion plate shown in FIG. 2.

In this embodiment, the plate main body 31 is provided, in a shape of a rhombus lattice, with non-flame-hole sections 33 in which flame holes 3*b* are not present (free of flame holes). Those sections of the plate main body 3*a* which are enclosed by the non-flame-hole sections 33 respectively constitute collective flame-hole sections 34 in which a plurality of flame holes 32 are formed densely (or in a crowded manner). In a concrete example with reference to FIG. 3, the length L of one side of the rhombus which circumscribes the flame holes 32*a* (hereinafter referred to as "peripheral flame holes") around the periphery of the collective flame-hole section 34 is set to be 8.9 mm, and the width W of the non-flame-hole sections 33 between these rhombi is set to be 3.6 mm. In each of the collective flame-hole sections 34, thirty-six flame holes 32 in all are formed so that the spacing (center distance) P between the adjoining flame holes in the direction parallel to the longitudinal direction of the non-flame-hole sections 33 (i.e., in the direction parallel to each side of the rhombus) becomes 1.6 mm.

Further, along each of that side of the non-flame-hole sections 33 which is adjacent to each of the collective flame-hole sections 34, there are formed flame holes 32' (hereinafter referred to as "outside flame holes") at a predetermined spacing from one another in the longitudinal direction of the non-flame-hole sections 33. This predetermined spacing, i.e., the longitudinal center distance P' between the adjoining outside flame holes 32' in the non-flame-hole sections 33 is set to be greater than the center distance P, in the longitudinal direction of the non-flame-hole section 31, of the flame holes 32 formed in the collective flame-hole sections 34. Preferably, P' shall be set greater than 2P. In this embodiment, an arrangement has been made that P' is equal to 3P.

Further, in this embodiment, outside flame holes 32' along one width side of the non-flame-hole sections 33 and outside flame holes 32' along the other width side of the non-flame-hole sections 33 are disposed at a positional shifting in the longitudinal direction of the non-flame-hole section 33. More specifically, the position of the outside flame holes 32' along one width side of the non-flame-hole section 33 and the position of the outside flame holes 32' along the other width side of the non-flame-hole section 33 are shifted from each other in the longitudinal direction of the non-flame-hole section 33 so that, at the top of an isosceles triangle having a base formed by a line connecting the centers of adjoining two outside flame holes 32', 32' along each of the width sides of the non-flame-hole sections 33, there is positioned the center of an outside flame hole 32' along the other width side of the non-flame-hole sections 33. According to this arrangement, all the spacing between the outside flame holes 32', 32' on both width sides of the non-flame-hole section 33 becomes equal to each other.

According to this embodiment, outside flame holes 32' will be disposed at several positions on the outside of the peripheral portion of the collective flame-hole sections 34. In this arrangement, against the premixed gas that recirculates from the outside flame holes 32' toward above the non-flame-hole sections 33, interference takes place: not only with the premixed gas that recirculates from those peripheral flame holes 32*a* of the collective flame-hole sections 34 which are positioned on the other side across the non-flame-hole sections 33, toward the above of the non-flame-hole sections 33; but also with the premixed gas that recirculates from those flame holes 32*a* around the periphery of the collective flame-hole sections 34 which are positioned on the same side as the outside flame holes 32' toward the above of the non-flame-hole sections 33. Therefore, the flame holding effect of the outside flame holes 32' can be increased. Therefore, even if flame lifting takes place in part of the peripheral flame holes 32*a* of the collective flame-hole sections 33, thanks to the flame holding at the outside flame holes 32', flame lifting can be prevented in the peripheral flame holes 32*a* adjacent to the outside flame holes 32'. As a result, even if the excess air ratio of the premixed gas is made higher, there can be effectively prevented the occurrence of the flame lifting in the entire peripheral flame holes 32*a*, as well as the occurrence of flame lifting, caused thereby, in the entire collective flame-hole sections 34.

By the way, if the outside flame holes 32' on laterally one side of the non-flame-hole sections 33 and the outside flame holes 32' on laterally the other side thereof are disposed in the same longitudinal positions of the non-flame-hole sections 33, the width of the non-flame-hole sections 33 will become considerably small at the portions between the outside flame holes 32', 32'. At these portions the premixed gas will not satisfactorily be recirculated, thereby deteriorating the flame stabilizing effect of the outside flame holes 32'.

On the other hand, according to this embodiment, the outside flame holes 32' on laterally one side of the non-flame-hole sections 33 and the outside flame holes 32' on laterally the opposite side thereof are disposed in an offset positional relationship with each other in the longitudinal direction of the non-flame-hole sections 33. According to this arrangement, relative to each of the outside flame holes 32', the peripheral flame holes 32*a* in the peripheral portions of the collective flame-hole sections 34 on the other side lie opposite to each other across the non-flame-hole sections 33. According to this arrangement, the width of the non-flame-hole sections 33 can be prevented from getting narrower between the outside flame holes 32', 32' to an excessive degree. Still furthermore, the premixed gases that recirculate from both the outside flame holes 32', 32' of the non-flame-hole sections 33 to above the non-flame-hole sections 33 will interfere with each other. As a result, the flame stabilizing effect of the outside flame holes 32' will further be improved. In particular, according to this embodiment, the spacing between the outside flame holes 32', 32' on laterally both sides of the non-flame-hole sections 33 is arranged to be all equal to one another. Therefore, high flame stabilizing effect can be obtained in all of the outside flame holes 32', thereby still more effectively preventing the occurrence of flame lifting.

However, according to the arrangement as it is, if the combustion takes place near the surface of the combustion plate 3 with short flame lengths due to low-load combustion, the temperature of the non-flame-hole section 33 will increase, whereby the performance against flashback cannot be fully improved. As a solution, according to this embodiment, the diameter of the peripheral flame holes 32*a* in the collective flame-hole sections 34 is made smaller than the diameter of the flame holes 32*b* formed in the portion inner than the peripheral portion of the collective flame-hole sections 34 (hereinafter referred to as "central flame holes"). Further, the diameter of the outside flame holes 32' is also made smaller than the diameter of the central flame holes 32*b*. The ratio between the diameters of the peripheral flame holes 32*a* and of the outside flame holes 32', and the diameter of the central flame holes 32*b* shall preferably be 1:1.2 to 1.5. In this embodiment, the diameter of the central flame holes 32*b* is 1.1 mm and the diameters of the peripheral flame holes 32*a* and of the outside flame holes 32' are 0.9 mm.

As described hereinabove, by making the diameter of the peripheral flame holes 32*a* smaller, the amount of premixed gas to be ejected out of the peripheral flame holes 32*a* can be reduced, and the amount of heating of the non-flame-hole sections 33 can be reduced. As a result, as compared with an example in which the diameter of the peripheral flame holes 32*a* is not made smaller, the temperature of the non-flame-hole sections 33 at the time of low-load combustion can be lowered, whereby the performance against flashback can be improved.

By the way, since the number of the outside flame holes 32' is small, even if the diameter of the outside flame holes 32' is not made small, the temperature of the non-flame-hole section 33 at the time of low-load combustion can be lowered by making the diameter of the peripheral flame holes 32*a* smaller. However, by making the diameter also of the outside flame holes 32' smaller as described above, the temperature of the non-flame-hole section 33 at the time of low-load combustion can still further be lowered, whereby the performance against flashback can further be improved.

Figure 4:
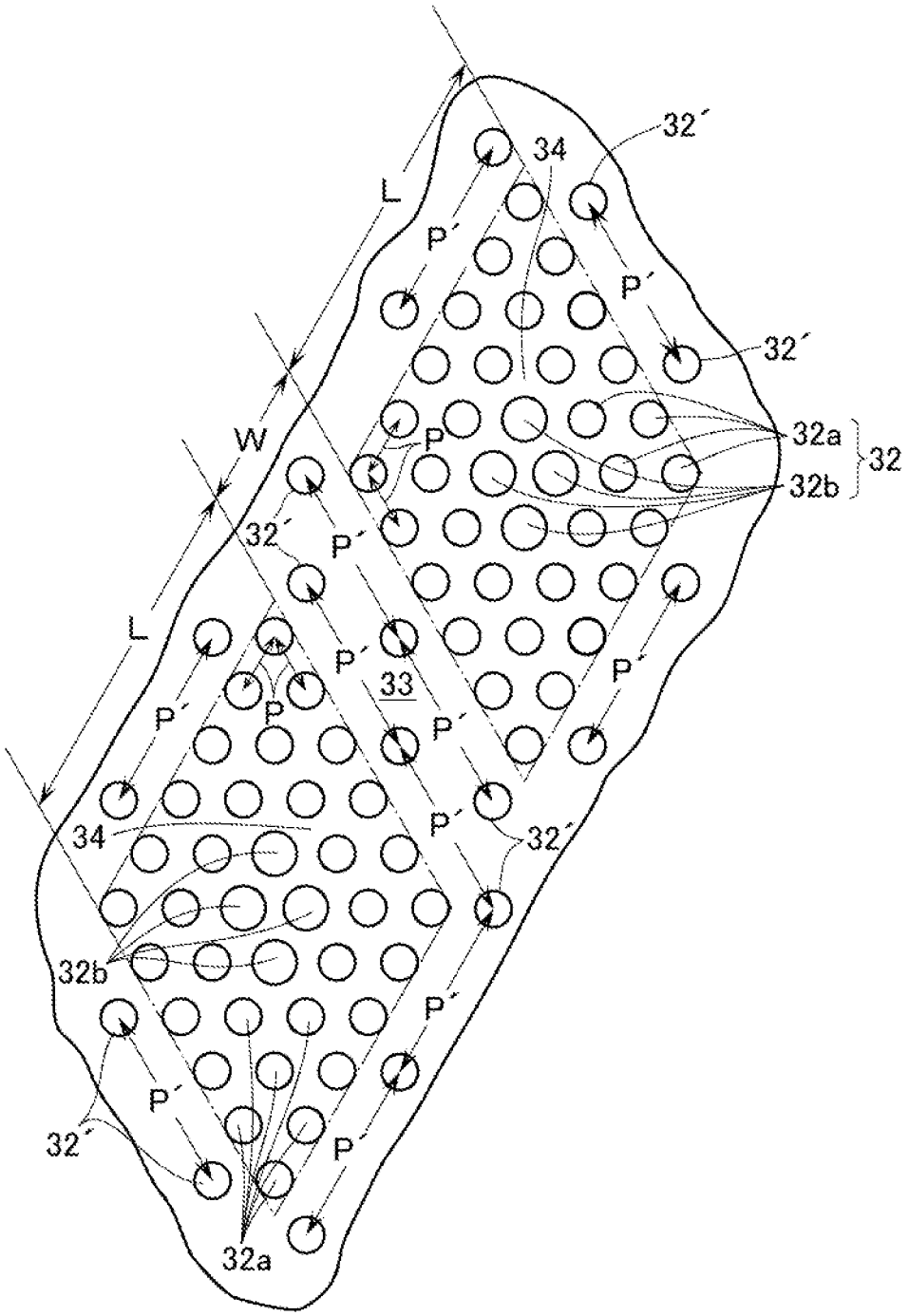
FIG. 4 is a partly enlarged plan view of a combustion plate according to another embodiment.

Furthermore, according to the above-mentioned embodiment, an arrangement has been made that the outermost row of flame holes that are in contact with the non-flame-hole sections 33 are made to be the small-diameter peripheral flame holes 32*a* among the flame holes 32 in the collective flame-hole sections 34. However, without being limited thereto, an arrangement may alternatively be made that, as shown in FIG. 4, the flame holes on the outermost row and the row on the inner side thereof, i.e., two rows of flame holes may be made the peripheral flame holes 32*a* of smaller diameter.

Descriptions have so far been made of embodiments of this invention with reference to the drawings, but this invention shall not be limited to the above. For example, in the above-mentioned embodiments, the outside flame holes 32' are formed in the non-flame-hole sections 33. The outside flame holes 32' may be abolished, so that no flame holes are formed at all in the non-flame-hole sections 33. Further, in the above-mentioned embodiments the shape of the collective flame-hole sections 34 is made into a rhombus, but this shape may be polygons, other than rhombus, in the shapes of triangle to hexagon.

EXPLANATION OF REFERENCE MARKS

3 . . . combustion plate
31 . . . plate main body
32 . . . flame hole
32*a* . . . flame holes to be formed in the peripheral portion of the collective flame-hole section
32*b* . . . flame holes to be formed on a side inner than the peripheral portion of the collective-flame section
32' . . . flame holes to be formed on a side portion of the non-flame-hole section
33 . . . non-flame-hole section
34 . . . collective flame-hole section

What is claimed is:

1. A combustion plate for use in a totally aerated combustion burner in which a plate main body made of ceramic has formed therein a multiplicity of flame holes for ejecting a premixed gas, wherein the plate main body is provided, in a lattice shape, with non-flame-hole sections free of flame holes, each of those sections of the plate main body which are enclosed by the non-flame-hole sections constituting a collective flame-hole section having formed therein in a crowded manner a plurality of flame holes, characterized in that flame holes formed in those peripheral portions of the collective flame-hole sections which are adjacent to the non-flame-hole sections are smaller in diameter than the diameter of the flame holes formed in those portions of the collective flame-hole sections which are inner than the peripheral portions;

wherein the flame holes formed in each of the side portions of the non-flame-hole sections are also smaller in diameter than the diameter of those flame holes formed in those portions of the collective flame-hole sections which are inner than the peripheral portions.

2. The combustion plate according to claim 1, wherein flame holes are formed in each of those side portions of the non-flame-hole sections which are adjacent to the respective collective flame-hole sections, the flame holes being formed at a predetermined spacing from one another in a longitudinal direction of the non-flame-hole sections, and wherein the predetermined spacing is set larger than the spacing from one another of the flame holes formed in the collective flame-hole sections as seen in a direction parallel to the longitudinal direction of the non-flame-hole sections.

* * * * *